US008234729B2

(12) United States Patent
Yvernault et al.

(10) Patent No.: US 8,234,729 B2
(45) Date of Patent: Aug. 7, 2012

(54) HOSPITAL BED WITH ADJUSTABLE SLEEPING SURFACE

(75) Inventors: Etienne Yvernault, Auray (FR); Pascal Guguin, Brech (FR)

(73) Assignee: Hill-Rom Industries S.A., Pluvigner (FR)

( * ) Notice: Subject to any disclaimer, the term of this patent is extended or adjusted under 35 U.S.C. 154(b) by 8 days.

(21) Appl. No.: 12/903,637

(22) Filed: Oct. 13, 2010

(65) Prior Publication Data

US 2011/0088167 A1 Apr. 21, 2011

(30) Foreign Application Priority Data

Oct. 20, 2009 (FR) ..... 09 57345

(51) Int. Cl.
*A47B 7/00* (2006.01)

(52) U.S. Cl. ..... 5/611; 5/11; 5/600

(58) Field of Classification Search ..... 5/11, 600, 5/611, 509.1; 108/145, 147
See application file for complete search history.

(56) References Cited

U.S. PATENT DOCUMENTS

| | | | | |
|---|---|---|---|---|
| 392,009 | A | | 10/1888 | Cleaveland |
| 541,339 | A | | 6/1895 | Thompson |
| 1,089,208 | A | * | 3/1914 | Olson ..... 5/600 |
| 1,206,536 | A | | 11/1916 | Hill |
| 1,218,519 | A | | 3/1917 | Bradley |
| 1,347,271 | A | | 7/1920 | Hartman |
| 1,902,249 | A | | 3/1933 | Lanzy |
| 2,026,153 | A | | 12/1935 | Wright et al. |
| 2,262,643 | A | | 11/1941 | McNabb |
| 2,523,076 | A | | 9/1950 | Sweetland |
| 2,590,337 | A | | 3/1952 | McNabb et al. |
| 2,658,207 | A | | 11/1953 | Robbins |
| 2,681,454 | A | | 6/1954 | Tallman |
| 2,765,477 | A | * | 10/1956 | Royce ..... 5/100 |
| 2,885,692 | A | * | 5/1959 | Wetzel et al. ..... 5/11 |
| 2,913,300 | A | | 11/1959 | Darnell et al. |
| 2,968,050 | A | | 1/1961 | Shankman |
| 3,012,253 | A | * | 12/1961 | Reichert ..... 5/616 |
| 3,032,154 | A | | 5/1962 | McNabb, Jr. |
| 3,045,256 | A | * | 7/1962 | Scher ..... 5/11 |
| 3,061,843 | A | | 11/1962 | Singer et al. |
| 3,237,212 | A | | 3/1966 | Hillenbrand et al. |
| 3,271,795 | A | | 9/1966 | Hillenbrand et al. |
| 3,281,872 | A | | 11/1966 | Dewey |
| 3,309,717 | A | | 3/1967 | Black |
| 3,436,769 | A | | 4/1969 | Burst |
| 3,564,627 | A | | 2/1971 | Allard et al. |
| 3,633,225 | A | | 1/1972 | Burst et al. |
| 3,636,573 | A | | 1/1972 | Bartz |
| RE27,966 | E | | 4/1974 | Burst |
| 3,821,821 | A | | 7/1974 | Burst et al. |
| 3,974,530 | A | | 8/1976 | Lusch et al. |
| 4,005,497 | A | | 2/1977 | Sutter |
| 4,043,219 | A | | 8/1977 | Schatti |

(Continued)

FOREIGN PATENT DOCUMENTS

| | | |
|---|---|---|
| DE | 2023104 | 11/1971 |

(Continued)

*Primary Examiner* — William Kelleher
(74) *Attorney, Agent, or Firm* — Barnes & Thornburg LLP

(57) ABSTRACT

A hospital bed includes a mattress support attached to an end panel of adjustable height. The panel comprises a lower frame and a movable upper frame defining between them two spaced vertical uprights, of telescopic structure, an actuating cylinder, and an extension amplification mechanism.

15 Claims, 4 Drawing Sheets

U.S. PATENT DOCUMENTS

| | | | | |
|---|---|---|---|---|
| 4,346,487 | A | 8/1982 | Holdt et al. | |
| 4,435,861 | A | 3/1984 | Lindley | |
| 4,494,259 | A | 1/1985 | Miller et al. | |
| 4,724,555 | A | 2/1988 | Poehner et al. | |
| 5,020,169 | A | 6/1991 | Hamada et al. | |
| 5,185,894 | A | 2/1993 | Bastert et al. | |
| 5,279,010 | A | 1/1994 | Ferrand et al. | |
| 5,544,375 | A | 8/1996 | Urness et al. | |
| 5,553,335 | A | 9/1996 | Lahtinen | |
| 5,685,035 | A | 11/1997 | Urness et al. | |
| 5,706,536 | A | 1/1998 | Krauska | |
| 5,724,685 | A | 3/1998 | Weismiller et al. | |
| 5,802,639 | A * | 9/1998 | Raasch et al. | 5/611 |
| 5,940,911 | A | 8/1999 | Wang | |
| 6,058,798 | A | 5/2000 | Lantzsch | |
| 6,101,647 | A | 8/2000 | Stroud et al. | |
| 6,305,499 | B1 | 10/2001 | Jones et al. | |
| 6,505,365 | B1 * | 1/2003 | Hanson et al. | 5/613 |
| 6,591,845 | B1 | 7/2003 | Bergman et al. | |
| 6,691,348 | B2 * | 2/2004 | Plummer et al. | 5/609 |
| 6,779,210 | B1 * | 8/2004 | Kelly | 5/611 |
| 7,653,954 | B2 | 2/2010 | Hornbach et al. | |
| 2004/0221386 | A1 | 11/2004 | Loewenthal | |
| 2005/0223491 | A1 * | 10/2005 | McCrimmon | 5/11 |
| 2006/0090260 | A1 | 5/2006 | Stryker et al. | |
| 2006/0260054 | A1 | 11/2006 | Lubbers et al. | |
| 2006/0265805 | A1 * | 11/2006 | Bellingroth | 5/11 |
| 2008/0148486 | A1 * | 6/2008 | Hornbach et al. | 5/611 |
| 2009/0070928 | A1 * | 3/2009 | Huang | 5/11 |
| 2010/0263120 | A1 * | 10/2010 | Kelly et al. | 5/11 |
| 2011/0271443 | A1 * | 11/2011 | Serhan et al. | 5/11 |

FOREIGN PATENT DOCUMENTS

| | | |
|---|---|---|
| DE | 3516081 | 11/1986 |
| EP | 0316905 | 5/1989 |
| EP | 0403073 | 12/1990 |
| EP | 0558838 | 9/1993 |
| EP | 1726280 | 11/2006 |
| FR | 2725600 | 4/1996 |
| GB | 2386062 | 10/2003 |
| WO | WO 82/01342 | * 4/1982 |
| WO | WO 9820829 | 5/1998 |

* cited by examiner

HOSPITAL BED WITH ADJUSTABLE SLEEPING SURFACE

CROSS-REFERENCE TO RELATED APPLICATIONS

The present application claims priority, under 35 U.S.C. §119(a), of French National Application No. 0957345 which was filed Oct. 20, 2009 and which is hereby incorporated by reference herein.

BACKGROUND

The present disclosure relates to a hospital bed with a sleeping surface adjustable in height and/or incline. More particularly, the present disclosure concerns a mechanism allowing different adjustment ranges to be defined while preserving a large number of identical components in the adjustment mechanism.

In a hospital bed, including those used in nursing homes and other healthcare facilities, it is known to be able to adjust the height of the sleeping surface (e.g., the patient's mattress). For example, the sleeping surface is placed relatively low so that the patient can easily get up by himself, if permitted to do so, or even lower to limit the risk of injury in the event of a fall. Otherwise, it is possible to raise the sleeping surface (and, in some instances, lowering the side rails) so that the patient can be more easily reached by the healthcare personnel. A raised position is also convenient for the lateral transfer of the patient to or from a stretcher. Finally, in some cases, it may be desirable for the sleeping surface to be inclined.

Mechanisms that are built into the end panels of the bed to enable these adjustments are known. In some known hospital beds, a mattress support is adjustable in height by being attached to at least one end panel of adjustable height operated by an actuating cylinder. The end panel comprises a lower frame resting on the floor and a movable upper frame to which the mattress support is attached. Thus, the position and/or incline of the sleeping surface can be adjusted, but the amplitude of the range of adjustment is limited to that of said actuating cylinder installed between the two frames. As a result, the sleeping surface has a minimum lower position, and a maximum upper position situated at a given distance above said lower position.

Depending on the nature of the treatment, it may be desirable to have a bed capable of offering a greater amplitude of adjustment, for example, to obtain a lower position and limit injuries to the patient in the event of a fall. The use of an actuating cylinder of greater extension would involve modifying the dimensions of practically all the other elements of the end panel. Moreover, the use of an actuating cylinder of this type would make it difficult to install it in the space allowed. A result would be higher manufacturing costs due to the need to manufacture and store a greater number of parts.

SUMMARY

A purpose of the embodiments disclosed herein is to resolve this type of problem by making it possible to standardize a large number of components needed for the manufacture of beds of different characteristics, particularly with respect to the amplitude of adjustment of the height of the sleeping surface.

More particularly, the present disclosure therefore concerns a hospital or healthcare bed of the type comprising a height-adjustable mattress support attached to a height-adjustable end panel operated by an actuating cylinder, said panel comprising a lower frame resting on the floor and a movable upper frame to which said mattress support is attached, characterized in that the two frames define between them two spaced vertical uprights, of telescopic structure, in that said frames comprise two respective articulation points of said vertical uprights, in that said actuating cylinder also comprises two articulation points, a first articulation point connected to the articulation point of one of said frames and a second articulation point connected to an extension amplification mechanism arranged between the frame to which said actuating cylinder is articulated and the articulation point of the other frame, and in that said actuating cylinder is such that its second articulation point is capable of being connected directly to said articulation point of the other frame.

According to one contemplated embodiment, said first articulation point of the actuating cylinder is connected to said lower frame and said second articulation point of the actuating cylinder is connected to said extension amplification mechanism.

The actuating cylinder is of the motorized type in some embodiments. For example, a screw jack driven by a motor mounted on the body of the jack is one possibility. In this case, the motor is optionally installed on the feet of the lower frame.

In some embodiments, the end panel comprises two flat recessed panels respectively integral with the two frames and open towards each other. The cross sections of the two recessed panels are different so that one can slide inside the other while housing the actuating cylinder and the extension amplification mechanism. The latter optionally comprises a set of elements articulated to each other as well as to said actuating cylinder and to said articulation point of said other frame. The paths of the elements of this mechanism may fall within the same plane so that they can be housed and can move inside the recessed panels.

In some contemplated embodiments, the bed according to the present disclosure is equipped with two similar end panels according to the foregoing description, respectively forming the head and foot of the bed.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The embodiments will be better understood and other features thereof will become clearer from the following description of currently contemplated embodiments of a hospital bed according to its principle, given solely by way of examples and provided with reference to the appended drawings, in which.

DETAILED DESCRIPTION

Figure 1:
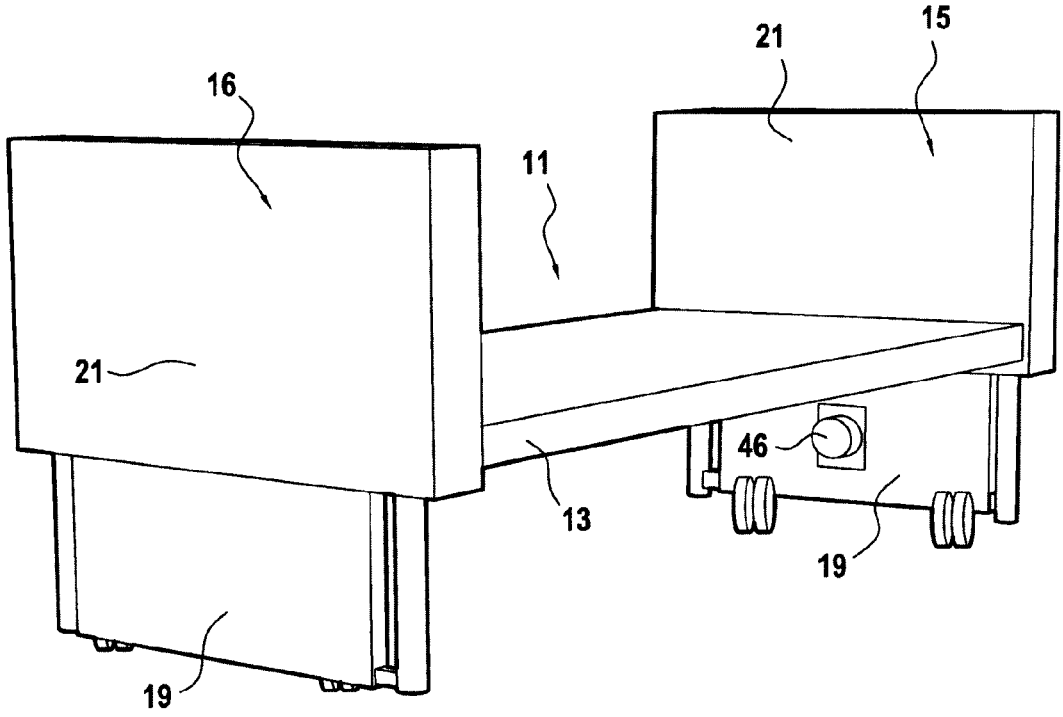
FIG. 1 is a perspective view of one embodiment of a hospital bed according to the present disclosure.

A hospital bed 11 comprises a mattress support 13 adjustable in height due to the fact that it is attached to two end panels 15, 16 that are adjustable in height, respectively forming the head and foot of the bed as shown in FIG. 1. Each end panel 15, 16 comprises two flat recessed panels 19, 21 open towards each other and of different cross sections to allow one to slide inside the other. More particularly, the lower recessed panel 19 has a smaller cross section than the upper recessed panel 21, so that the latter can receive part of the lower recessed panel 19. Each end panel 15, 16 comprises a lower frame 23 resting on the floor and a movable upper frame 25 to which the mattress support 13 is attached. The lower recessed panel 19 is integral with the lower frame 23 and the upper recessed panel 21 is integral with the upper frame 25. Thus, when the two opposite upper panels 21 move jointly and vertically with respect to the two lower recessed panels 19, they carry along the mattress support 13, which allows the height thereof to be adjusted with respect to the floor. The incline of the mattress support 13 is also adjustable by a difference of adjustment of the height of the two frames 23, 25.

Figure 2:
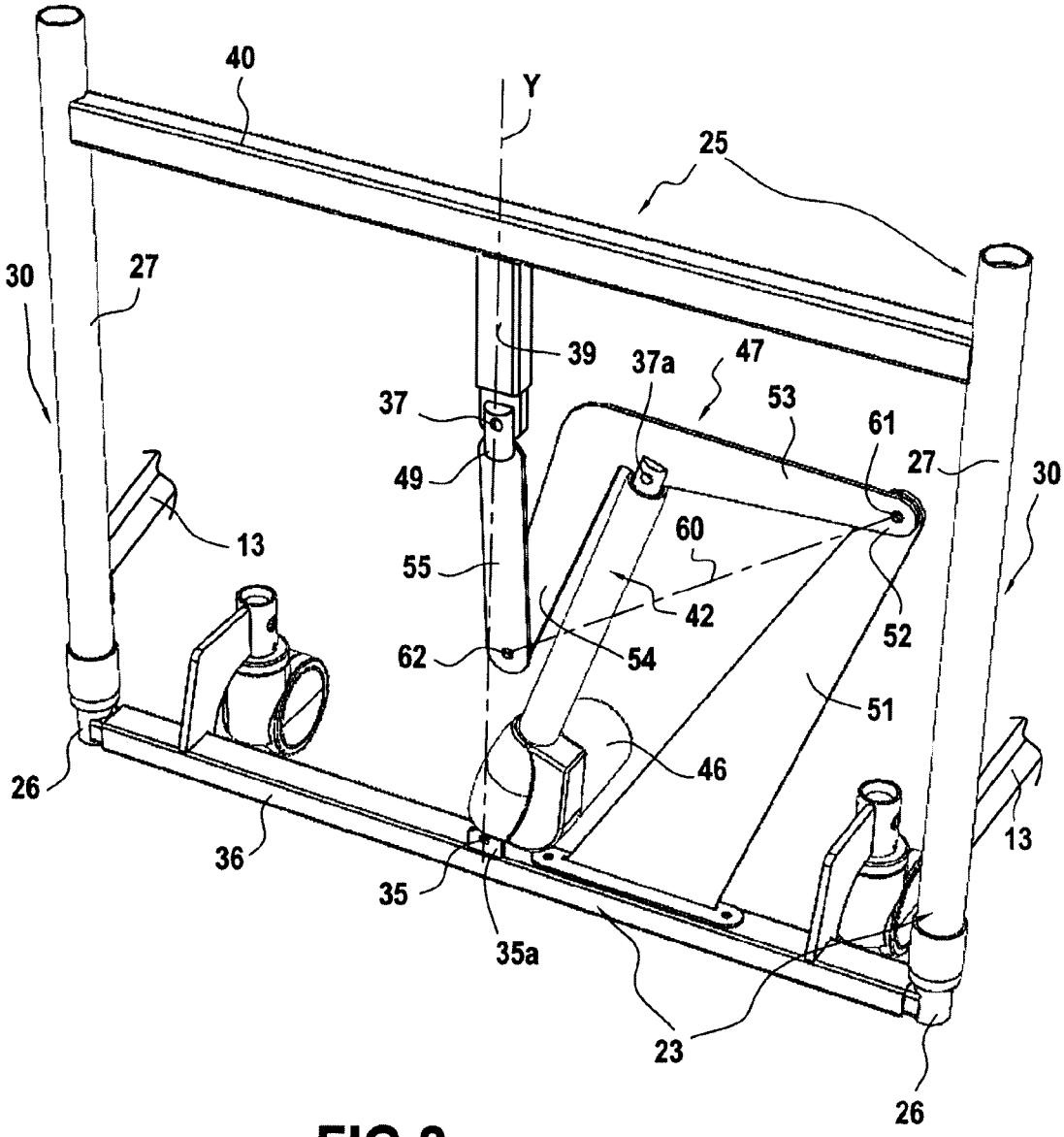
FIG. 2 is a perspective view illustrating the internal structure of an end panel of the bed, of adjustable height and making it possible to obtain a large amplitude of extension adjustment.
Figure 3:
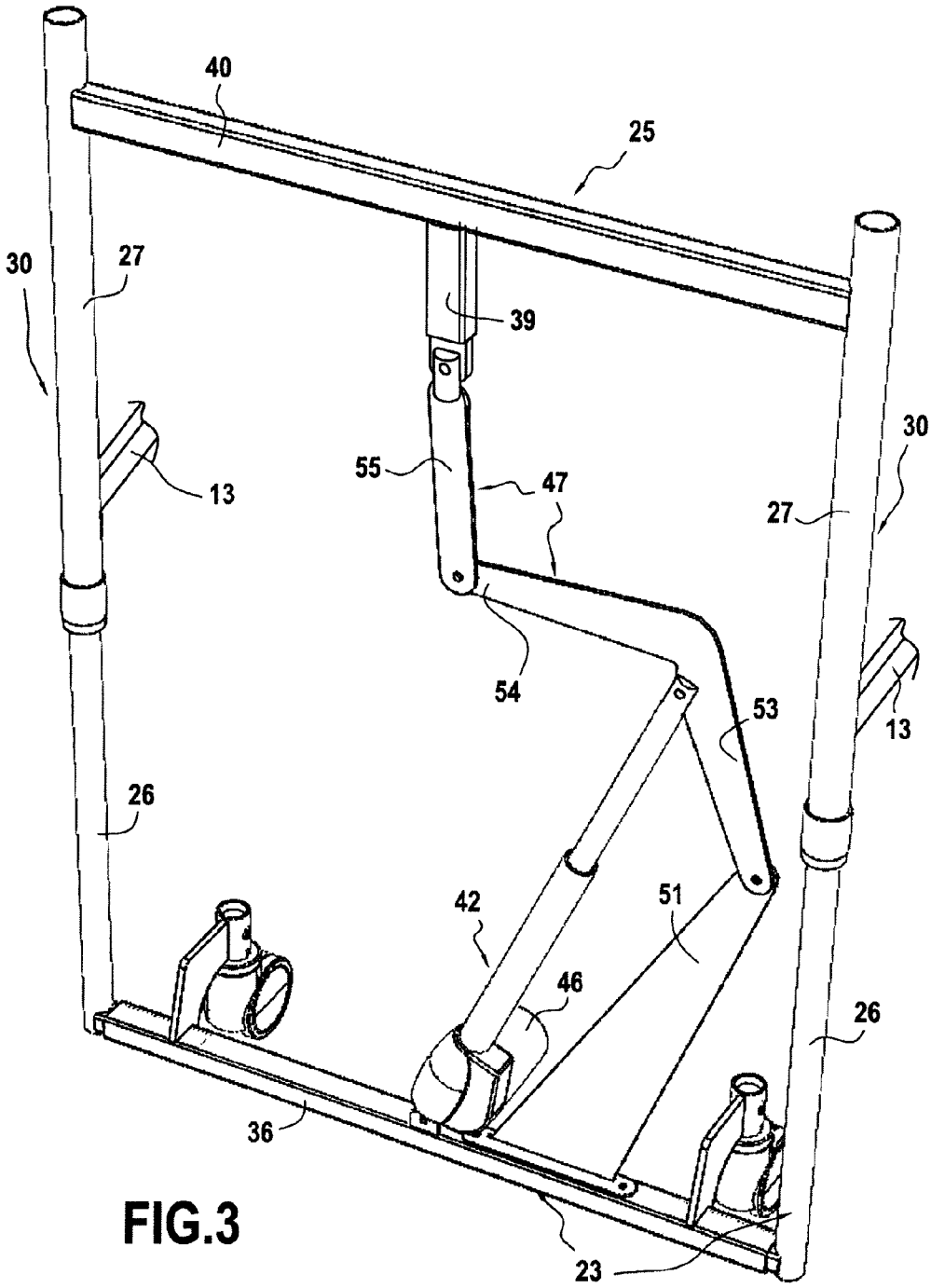
FIG. 3 is a view similar to FIG. 2, illustrating the movement of the mechanism.

As can be seen more particularly in FIGS. 2 and 3, the two frames 23, 25 each comprise two vertical tubular elements 26, 27 respectively. The aligned elements 26, 27 of the two frames 23, 25 have different cross sections and are engaged inside each other. They thus define two spaced vertical uprights 30 with telescopic structure. Moreover, the two frames 23, 25 comprise two respective articulation points. More particularly, the lower frame 23 includes one articulation point 35 at the middle of a lower cross piece 36 while the upper frame 25 includes an articulation point 37 situated at the end of a vertical stub 39 secured at the middle of a cross piece 40. It will be noted that a line Y, shown in FIG. 2, passing through these two articulation points 35, 37 is vertical and, in the illustrative example, appreciably equidistant from the two vertical uprights 30 discussed above. An actuating cylinder 42 allows the position of the upper frame 25 to be adjusted with respect to the lower frame 23, and consequently, the height of the mattress support 13.

The actuating cylinder 42 also comprises two articulation points. A first articulation point 35*a* is connected to the articulation point 35 of one of said frames 23, while a second articulation point 37*a* is connected to an extension amplification mechanism 47 arranged between the frame 23 to which said actuating cylinder is articulated and the articulation point 37 of the other frame 23, 25. More specifically in the example, said first articulation point 35*a* of the actuating cylinder is directly connected to the articulation point 35 of the lower frame 23 while one end 49 of said extension amplification mechanism 47 is connected to the articulation point 37 of the upper frame 25 (thus forming a sort of yoke). In other words, the lower end of the actuating cylinder 42 is articulated here at the middle of the cross piece 36 of the lower frame 23 while the end 49 of the extension amplification mechanism is connected articulately to the cross piece 40 of the upper frame 25 by means of the stub 39.

The actuating cylinder 42 is of the motorized jack screw type. The motor 46 of this actuating cylinder is secured to one end of the body of the actuating cylinder 42 near its articulation point 35*a*. Once the actuating cylinder is mounted, the motor 46 is therefore installed at the foot of the lower frame 23, near the floor.

Figure 4:
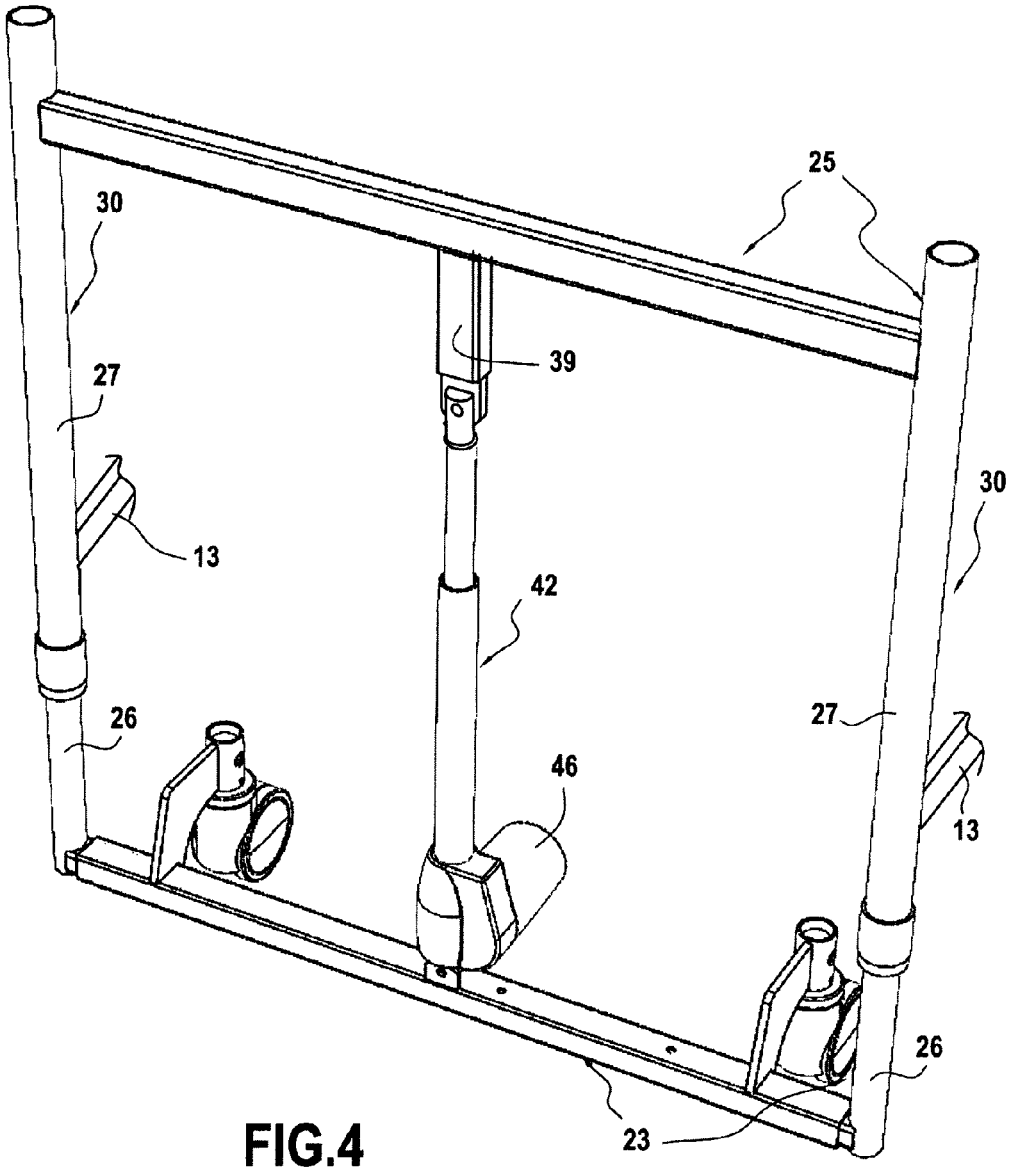
FIG. 4 illustrates a simplified version of the same end panel, using components identical to those of FIG. 2.

Furthermore, according to one feature, the second articulation point 37*a* of the actuating cylinder, i.e., here the one located at the end of the rod of the actuating cylinder 42, is capable of being connected directly to the articulation point 37 of the other frame, i.e., here the upper frame 25 as shown in FIG. 4.

As represented, the extension amplification mechanism 47 shown in FIG. 2 comprises a set of elements articulated to each other and these elements are also articulated to the actuating cylinder 42 as well as to said articulation point 37 of said other frame, i.e., here the upper frame 25. The paths of the elements of the extension amplification mechanism 47 fall within the same plane (e.g. its axes of articulation are parallel and horizontal) so that the actuating cylinder 42 and said extension amplification mechanism 47 move and are articulated with each other within the space defined by these two recessed panels 19, 21 nested in each other.

According to the example, said extension amplification mechanism 47 comprises a lateral upright 51 secured to the lower frame 23 and more particularly to the cross piece 36, an intermediate lever 53 articulated at one end of said upright 51 by one end 52. Its other end 54 is articulated to a connecting link 55, which in turn is articulated at the articulation point 37 of said upper frame 25. The intermediate lever 53 here has the approximate shape of a chevron and the end of the actuating cylinder 42 that is attached to the extension amplification mechanism 47 is articulated near the top of the chevron.

More generally, as can be seen in FIGS. 2 and 3, the end of the actuating cylinder 42 connected to the intermediate lever 53 is articulated thereto (articulation point 37*a*) at a point located above a line 60 joining the articulation points 61, 62 between the intermediate lever 53 on the one hand, and the upright 51 and the connecting link 55 on the other hand.

It can be seen clearly from FIGS. 2 and 3 that when the end panel 15, 16 is equipped with an extension amplification mechanism 47, the upper frame 25 benefits from a possible extension greater than the normal amplitude of the actuating cylinder 42. In comparison, in the simplified version of FIG. 4, the amplitude of the height adjustment extension of the mattress support 13 is equal to that of the actuating cylinder 42. However, both versions use strictly identical components, the version of FIG. 2 simply including the addition of the extension amplification mechanism 47. The actuating cylinders 42 used have extensions adapted to the desired amplitudes of variation of the height of the sleeping surface 13.

Although certain illustrative embodiments have been described in detail above, many embodiments, variations and modifications are possible that are still within the scope and spirit of this disclosure as described herein and as defined in the following claims.

The invention claimed is:

1. A hospital bed comprising a height-adjustable mattress support attached to a height-adjustable end panel operated by an actuating cylinder, said panel comprising a lower frame resting on a floor and a movable upper frame to which said mattress support is attached, the lower and upper frames define between them two spaced vertical uprights of telescopic structure, the lower and upper frames comprise two respective articulation points, the actuating cylinder also comprises two articulation points, a first articulation point of the actuating cylinder being connected to the articulation point of one of said upper and lower frames and a second articulation point of the actuating cylinder being connected to an extension amplification mechanism arranged between one of the lower and upper frame to which said actuating cylinder is articulated and the articulation point of the other of the lower and upper frame, wherein the actuating cylinder is such that its second articulation point is capable of being connected directly to said articulation point of the other of the lower and upper frame, wherein the extension amplification mechanism comprises a set of elements articulated to each other as well as to the actuating cylinder and to the articulation point of the other of the lower and upper frame, the paths of said elements falling within the same plane, wherein the extension amplification mechanism comprises a lateral upright secured to the lower frame, an intermediate lever articulated at one end to the lateral upright and at its other end to a connecting link, the connecting link in turn being articulated at the articulation point of the upper frame and the actuating cylinder being articulated at the intermediate lever.

2. The hospital bed of claim 1, wherein the articulation points of said lower and upper frames are appreciably equidistant from said vertical uprights.

3. The hospital bed of claim 1, wherein the first articulation point of the actuating cylinder is connected to the lower frame and the second articulation point of the actuating cylinder is connected to the extension amplification mechanism.

4. The hospital bed of claim 3, wherein the actuating cylinder is of the motorized type having a motor installed on the lower frame.

5. The hospital bed of claim 1, wherein the end panel comprises two flat recessed panels respectively integral with the lower and upper frames, open towards each other and of different cross sections allowing them to slide relative to each other while housing the actuating cylinder and the extension amplification mechanism.

6. The hospital bed of claim 1, wherein the end of the actuating cylinder connected to the intermediate lever is articulated thereto at a point located above a line joining the articulation points between the intermediate lever and the lateral upright and the connecting link and the intermediate lever.

7. The hospital bed of claim 1, wherein the intermediate lever has the approximate shape of a chevron and the corresponding end of the actuating cylinder is articulated near the top of said chevron.

8. The hospital bed of claim 7, wherein the end panel comprises a first end panel and the hospital bed includes a second end panel that is similar to the first end panel such that the first and second end panels, respectively, form the head and foot of the bed.

9. The hospital bed of claim 1, wherein the upper and lower frames each comprise a cross piece interconnecting the respective spaced vertical uprights.

10. The hospital bed of claim 9, wherein the cross pieces of the upper and lower frames are each oriented horizontally.

11. The hospital bed of claim 9, wherein the cross piece of the upper frame has a vertical stub extending downwardly therefrom.

12. The hospital bed of claim 11, wherein the extension amplification mechanism is coupled to the vertical stub at the articulation point.

13. The hospital bed of claim 11, wherein the vertical stub is located equidistantly from the spaced vertical uprights of the upper frame.

14. The hospital bed of claim 1, wherein the lateral upright is oriented nonvertically.

15. The hospital bed of claim 1, wherein the lateral upright is wider at its lower end than at its top end.

* * * * *